US005231915A

United States Patent [19]

Shimizu

[11] Patent Number: 5,231,915

[45] Date of Patent: Aug. 3, 1993

[54] WOBBLE PLATE TYPE COMPRESSOR HAVING CANTILEVERED DRIVE MECHANISM

[75] Inventor: Keiichi Shimizu, Honjo, Japan

[73] Assignee: Sanden Corporation, Gunma, Japan

[21] Appl. No.: 888,158

[22] Filed: May 26, 1992

[30] Foreign Application Priority Data

May 23, 1991 [JP] Japan ..... 3-45921[U]

[51] Int. Cl.[5] ..... F01B 3/00

[52] U.S. Cl. ..... 92/71; 417/269; 74/60

[58] Field of Search ..... 92/12.2, 71; 417/269; 74/60; 91/499

[56] References Cited

U.S. PATENT DOCUMENTS 2,997,956 8/1961 Stewart ..... 74/60

FOREIGN PATENT DOCUMENTS 0611078 12/1960 Canada ..... 417/269
2136127 2/1973 Fed. Rep. of Germany ..... 417/269
0590477 1/1978 U.S.S.R. ..... 417/269

*Primary Examiner*—Thomas E. Denion
*Attorney, Agent, or Firm*—Baker & Botts

[57] ABSTRACT

A wobble plate type compressor having a cantilevered drive mechanism is disclosed. The compressor includes a compressor housing having a plurality of cylinders and a crank chamber adjacent the cylinders. A reciprocative piston is slidably fitted within each of the cylinders. A drive mechanism is coupled to the pistons to reciprocate the pistons within the cylinders. The drive mechanism includes a drive shaft which extends through an opening of a front end plate and extends into the compressor housing. A cam rotor is attached to an inner end of the drive shaft and rotates therewith. A support mechanism radially and rotatably supports the drive mechanism. This support mechanism, which is formed within the cam rotor and interfits with the front end plate, includes a bearing located within the cam rotor. Accordingly, the above construction reduces the moment of force acting on the drive mechanism at its radial support center by moving the radial support center closer in the axial direction to the point on the cam rotor at which the maximum gas compression force acts. As a result, the life of the bearing, and the compressor itself, is increased and undesirable vibration of the drive mechanism during operation of the compressor is reduced.

9 Claims, 3 Drawing Sheets

WOBBLE PLATE TYPE COMPRESSOR HAVING CANTILEVERED DRIVE MECHANISM

BACKGROUND OF THE INVENTION

The present invention relates to a wobble plate type compressor for use in an automotive air conditioning system, and more particularly, to a wobble plate type compressor having a cantilevered drive mechanism.

DESCRIPTION OF THE PRIOR ART

Wobble plate type compressors having a cantilevered drive mechanism are well known in the art. For example, U.S. Pat. No. 4,722,671 to Azami et al. discloses a wobble plate type compressor having a cantilevered drive mechanism which is generally illustrated in FIG. 1 of the appended drawings. For purposes of explanation, the left side of FIG. 1 will be referred to as the forward or front end and the right side of the Figure will be referred to as the rearward or rear end of the compressor.

Referring to FIG. 1, the compressor includes cylindrical housing 10 including cylinder block 11, front housing 12 and cylinder head 13. Crank chamber 14 is defined by an inner hollow space of housing 10 between cylinder block 11 and front housing 12. Drive mechanism 15 includes wedge-shaped rotor 151 and drive shaft 152 connected to rotor 151 by pin member 16 at its inner end. Rotor 151 includes inclined surface 151*a* at its rear end. Rotor 151 is disposed in crank chamber 14 and is rotatably supported on an inner surface of front housing 12 through thrust needle bearing 17. Drive shaft 152 extends through axial hole 121, which is centrally formed through front housing 12, and is rotatably supported by thrust needle bearing 18. Wobble plate 19 is mounted on inclined surface 151*a* of rotor 151 through thrust needle bearing 20.

Cylindrical bore 11*a* is axially formed through a central portion of cylinder block 11 and extends to the rear end of cylinder block 11. Cylindrical member 22 is axially slidably disposed in bore 11*a*, but rotation thereof is prevented by key-groove mechanism 23. Cylindrical member 22 includes bevel gear portion 221 formed at the front end thereof. Bevel gear portion 221 includes spherical concavity 221*a* formed at its front end for receiving steel ball 21. Axial hole 222 is formed through cylindrical member 22 and extends to the rear end of cylindrical member 22. Coil spring 24 is disposed in axial hole 222 of cylindrical member 22. Screw member 25 is screwed into the rear end portion of bore 11*a* to adjust the axial position of cylindrical member 22. Coil spring 24 is compressedly sandwiched between the inner bottom surface of axial hole 222 and the front end surface of screw member 25 so that cylindrical member 22 is urged toward wobble plate 19 by the restoring force of spring 24. Bevel gear portion 221 of cylindrical member 22 engages bevel gear 26 fixedly mounted on wobble plate 19 so that rotation of wobble plate 19 is prevented during rotation of rotor 151. Steel ball 21 is placed within spherical concavity 26*a* formed at the rear end surface of the central portion of bevel gear 26 so that wobble plate 19 may be nutatably but non-rotatably supported on steel ball 21.

Cylinder block 11 is provided with a plurality of peripherally located axial cylinders 27 formed therein, within which pistons 28 are slidably and closely fitted. Each piston 28 is connected to wobble plate 19 through piston rod 29. The front end of each piston rod 29 is connected to wobble plate 19 by a ball joint mechanism. Similarly, the rear end of each piston rod 29 is connected to piston 28 by a ball joint mechanism.

Cylinder head 13 is disposed on the rear end of cylinder block 11 through valve plate assembly 31 having valve plate 311 and gaskets 312 and 313, and is secured thereto by bolts 30. Cylinder head 13 includes peripherally located suction chamber 32 and centrally located discharge chamber 33 defined by an inner hollow space of cylinder head 13. Partition wall 131 separates suction chamber 32 from discharge chamber 33. Suction chamber 32 is provided with inlet portion 32*a* which is connected to an element of an external cooling circuit, such as an evaporator (not shown). Discharge chamber 33 is provided with outlet portion 33*a* which is connected to another element of the external cooling circuit, such as a condenser (not shown). Valve plate assembly 31 includes valved suction ports 31*a* connecting suction chamber 32 and cylinders 27 and valved discharge ports 31*b* connecting discharge chamber 33 and cylinders 27. Stopper plate 34 suppresses excessive deformation of a discharge reed valve (not shown) associated with the valved discharge ports. Bolts and not device 35 secures stopper plate 34 to valve plate assembly 31.

In operation of the above described compressor, drive shaft 152 is driven by any suitable driving source, such as an automobile engine (not shown) through a transmitting device, such as an electromagnetic clutch (not shown). Rotor 151 rotates with drive shaft 152 which in turn causes wobble plate 19 to nutate about steel ball 21. The nutational motion of wobble plate 19 causes the reciprocating motion of each of pistons 28. As pistons 28 are reciprocated, refrigerant gas is introduced into suction chamber 32 through inlet portion 32*a* and flows into each cylinder 27 through suction ports 31*a* where it is compressed. The compressed refrigerant gas is discharged to discharge chamber 33 from each cylinder 27 through discharge ports 31*b*, and therefrom into the external cooling circuit through outlet portion 33*a*.

During operation of the compressor, a gas compression force acts on point A which is located on inclined surface 151*a* of rotor 151 near the ball joint mechanism of piston rod 29 and wobble plate 19. The gas compression force is maximized when each piston 28 is at its top dead point, which occurs when the thicker portion (to the top in FIG. 1) of rotor 151 is adjacent each piston 28. Since the maximum gas compression force acts on inclined surface 151*a* of rotor 151, it includes radial component force $F_r$. Radial component force $F_r$ creates a moment of force $F_r \times l'$, where $l'$ is a distance between point A and a radial supporting center C' of drive mechanism 15 in the axial direction. This moment causes drive mechanism 15 to shift around an axis which passes through radial supporting center C' of drive mechanism 15 and is perpendicular to the axis of drive shaft 152.

The shifting of drive mechanism 15 in response to the above moment creates nonuniform contact between the exterior surface of drive shaft 152 and the inner peripheral surface of thrust needle bearing 18. This causes fragmentation of the exterior surface of drive shaft 152 and the inner peripheral surface of thrust needle bearing 18, particularly when the compressor operates under severe operating conditions, such as the occurrence of a high thermal load on the evaporator of the external cooling circuit to which the compressor may be connected. This fragmentation decreases the life of bearing 18, and creates an undesirable clearance between drive shaft 152 and thrust needle bearing 18. This then results in an undesirable vibration of drive mechanism 15 during operation of the compressor.

One proposed solution to the above described disadvantages is to reduce the axial thickness of rotor 151 to thereby move point A axially closer to point C' which would reduce the magnitude of the moment of force acting on drive mechanism 15. However, thinning the axial thickness of rotor 151 reduces the rigidity of drive mechanism 151, which in turn decreases the capability of drive mechanism 15 to bear the reduced moment of force acting on drive mechanism 15. Under severe operating conditions drive mechanism 15 may be damaged.

SUMMARY OF THE INVENTION

Accordingly, an object and advantage of the present invention is to improve the durability and life of a wobble plate compressor having a cantilevered drive mechanism. In particular, it is an object and advantage of this invention to improve the life of a bearing which radially and rotatably supports a drive shaft of the cantilevered drive mechanism without diminishing the drive mechanism below a certain value which can bear the moment of force acting on the drive mechanism under severe operating conditions.

Another object and advantage of the present invention to provide a wobble plate type compressor having a cantilevered drive mechanism in which vibration of the drive mechanism during operation of the compressor is significantly reduced.

In order to obtain the above objects and advantages, a wobble plate type compressor in accordance with the present invention includes a compressor housing having a plurality of cylinders and a crank chamber adjacent the cylinders. A reciprocative piston is slidably fitted within each of the cylinders. A front end plate with a central opening is attached to one end surface of the compressor housing. A drive mechanism is coupled to the pistons to reciprocate the pistons within the cylinders. A supporting mechanism radially and rotatably supports the drive mechanism. The drive mechanism includes a drive shaft extending through the central opening of the front end plate and a wedge-shaped cam rotor attached to an inner end of the drive shaft. The supporting mechanism is located in the wedge-shaped cam rotor and interfits with the front end plate.

Further objects, advantages, features and other aspects of this invention will be understood from the following detailed description of the preferred embodiments of the invention and by referring to the annexed drawings.

DETAILED DESCRIPTION OF THE PREFERRED EMBODIMENTS

Figure 1:
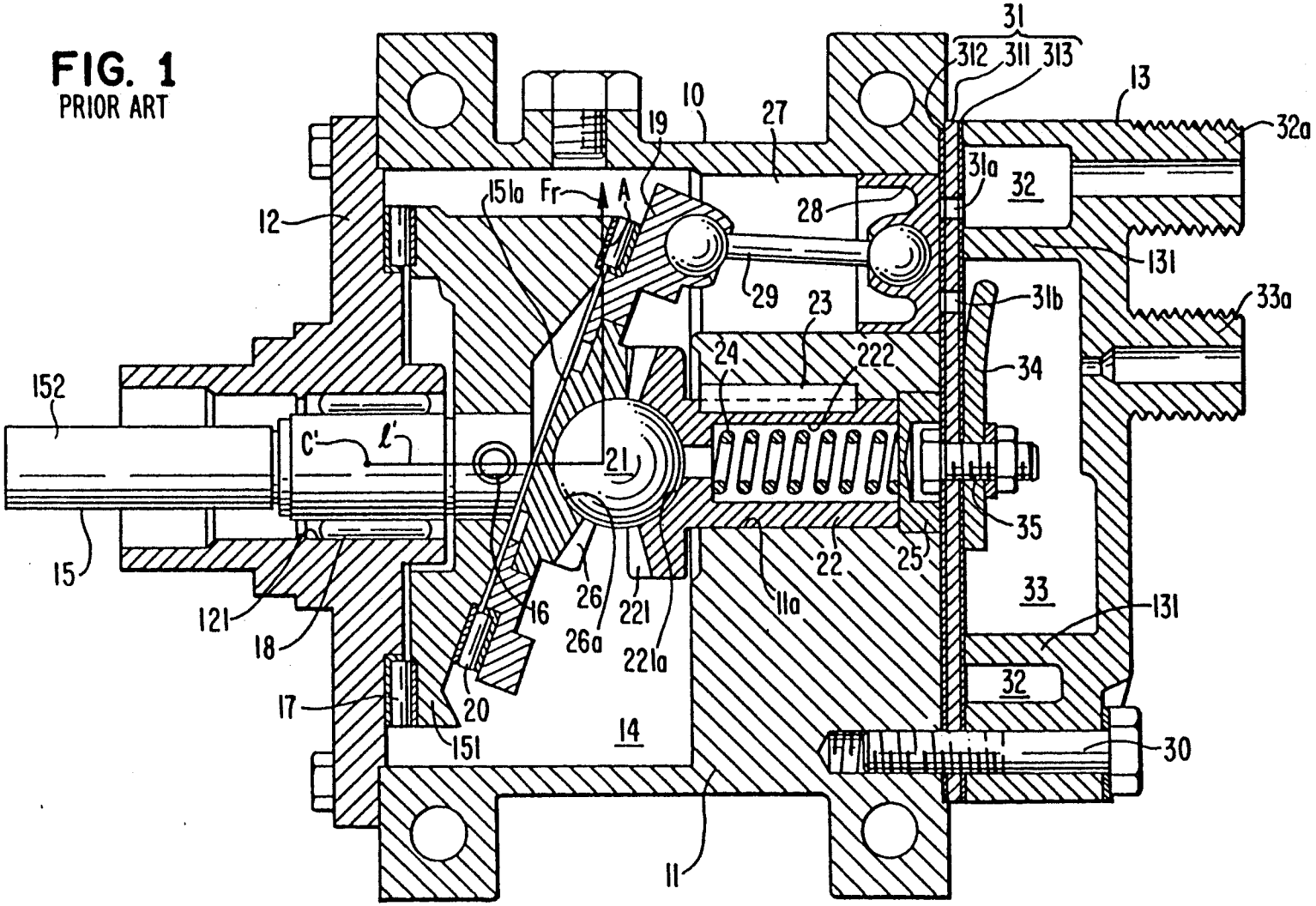
FIG. 1 PRIOR ART
FIG. 1 illustrates a longitudinal sectional view of a conventional wobble plate type compressor having a cantilevered drive mechanism.
Figure 2:
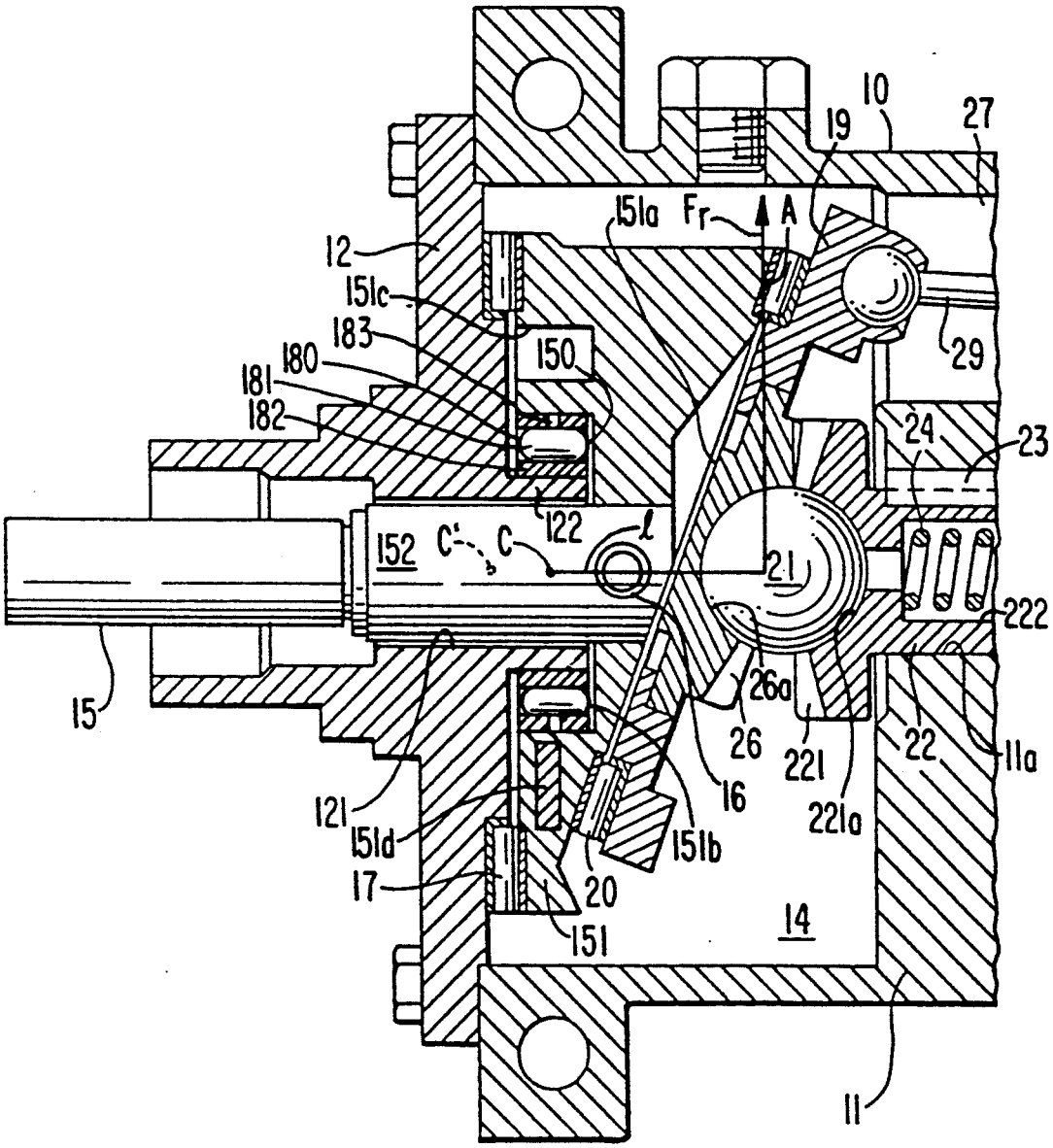
FIG. 2 is an enlarged cross sectional view of a relevant part of a wobble plate type compressor having a cantilevered drive mechanism in accordance with a first embodiment of the present invention.
Figure 3:
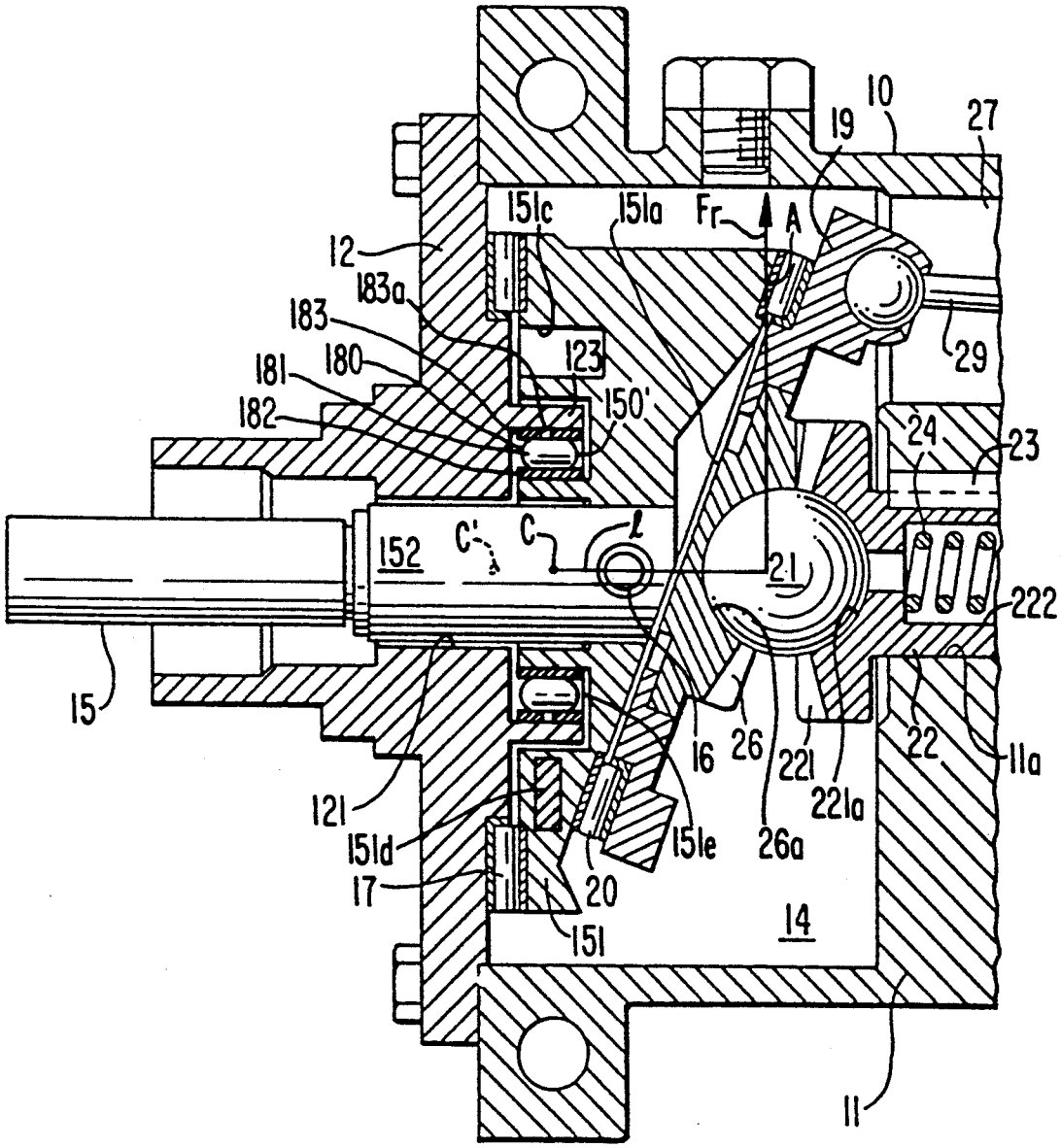
FIG. 3 is an enlarged cross sectional view of a relevant part of a wobble plate type compressor having a cantilevered drive mechanism in accordance with a second embodiment of the present invention.

FIGS. 2 and 3 illustrate first and second embodiment of the present invention, respectively. In the drawings, the same numerals are used to denote the same elements shown in FIG. 1. Furthermore, for purposes of explanation, the left side of the Figures will be referred to as the forward or front end and the right side of the Figures will be referred to as the rearward or rear end.

Referring to FIG. 2, according to the first embodiment, rotor 151 includes cylindrical depression 151*b* formed at a central portion of its front end surface. Annular cylindrical projection 122 extends from a rear end surface of front housing 12 adjacent an inner peripheral wall of axial hole 121. Projection 122 interfits with rotor 151, i.e., it terminates at a position which is adjacent to a bottom surface of cylindrical depression 151*b*. Consequently, annular space 150 is defined by the hollow space of depression 151*b* between the outer peripheral surface of projection 122 and the side wall of cylindrical depression 151*b*. Thrust needle bearing 180 having a plurality of cylindrical rolling elements 181, and inner and outer races 182 and 183, is fixedly disposed in annular hollow space 150 to allow rotor 151 to rotate. Outer race 183 of bearing 180 includes a plurality of radial holes 183*a* which permit lubricating oil to pass from crank chamber 14 to the frictional surfaces between outer race 183 and rolling elements 181, and between inner race 182 and rolling elements 181.

The thicker portion (to the top side in FIG. 2) of rotor 151 includes cavity 151*c* formed at its front end surface at a location radially outward of depression 151*b*. The thinner portion (to the bottom side of FIG. 2) of rotor 151 includes member 151*d* molded in rotor 151 at a location which radially outward of depression 151*b*. The specific gravity of member 151*d* is greater than the specific gravity of rotor 151.

In accordance with the construction of the compressor as described above, the radial supporting center C of drive mechanism 15 is in closer proximity to point A in the axial direction as compared with the radial supporting center C' of the prior art drive mechanism illustrated in FIG. 1, assuming the same approximate thickness of rotor 151. That is, distance 1 between the radial supporting center C of drive mechanism 15 and point A is smaller than distance l' as described in the prior art compressor of FIG. 1. Therefore, during operation of the compressor, the moment of force $F_r \times 1$ created by radial component force $F_r$ at the maximum gas compression force is sufficiently reduced so that fragmentation of the exterior surface of drive shaft 152 and the inner peripheral surface of bearing 180 does not occur, particularly during operation of the compressor under severe operating conditions. Additionally, the rigidity of drive mechanism 15 is maintained at a value which can bear the moment of force acting on drive mechanism 15 under severe operating conditions.

As a result, the life of bearing 180, and the life of the compressor, is increased without loss in the rigidity of drive mechanism 15. Furthermore, undesirable vibration of drive mechanism 15 during operation of the compressor is significantly reduced.

Referring to FIG. 3, according to the second embodiment, rotor 151 includes annular cylindrical depression 151*e* formed at a central portion of its front end surface. Annular cylindrical projection 123 extends from a generally mid portion of the rear end surface of front housing 12 and interfits with rotor 151, i.e., it terminates at a position which is adjacent to a bottom surface of annular cylindrical depression 151*e*. Consequently, annular space 150' is defined by the hollow space of depression 151*e* between the inner side wall of annular cylindrical depression 150*e* and the inner peripheral surface of projection 123. Thrust needle bearing 180, which contains the same components described above in connection with FIG. 2, is fixedly disposed in annular hollow space 150' to allow 151 to rotate. While the construction of the embodiment of FIG. 3 is different than FIG. 2, the operation is similar to the operation of the FIG. 2 embodiment, and the same results and advantages described in connection with FIG. 2 are achieved with the construction of FIG. 3.

Furthermore, with respect to both FIGS. 2 and 3, it should be noted that an additional thrust needle bearing may be fixedly disposed in axial hole 121 of front housing 12 for radially and rotatably supporting drive shaft 152. This additional thrust needle bearing would be like the one described and illustrated in connection with FIG. 1.

This invention has been described in detail in connection with the preferred embodiments, which are merely for illustrative purposes only and the invention is not limited thereto. It will be understood by those skilled in the art that variations and modifications can be easily made within the scope of this invention as defined by the appended claims.

What is claimed is:

1. In the compressor including a compressor housing having therein a plurality of cylinders, a reciprocative piston slidably fitted within each of said cylinders, a front end plate with a central opening attached to one end surface of said compressor housing, a drive mechanism coupled to said pistons to reciprocate said pistons within said cylinders, said drive mechanism including a drive shaft which extends through said central opening of said front end plate and a cam rotor which is attached to one end of said drive shaft, the improvement comprising:

support means formed within said cam rotor, radially fixed in close proximity to the drive shaft, and interfitted with said front end plate for rotatably supporting said drive mechanism on said front end plate.

2. The compressor of claim 1 wherein said support means includes a cylindrical depression formed in an end surface of said cam rotor facing an inner surface of said front end plate, an annular cylindrical projection extending from said inner surface of said front end plate to a position within said cylindrical depression, an annular space formed between an outer peripheral surface of said annular cylindrical projection and a side wall of said cylindrical depression and a bearing fixedly disposed in said annular space.

3. The compressor of claim 1 wherein said support means includes an annular cylindrical depression formed in an end surface of said cam rotor facing an inner surface of said front end plate, an annular cylindrical projection extending from said inner surface of said front end plate to a position within said annular cylindrical depression, an annular space formed between an inner side wall of said annular cylindrical depression and an inner peripheral surface of said annular cylindrical projection, and a bearing fixedly disposed in said annular space.

4. The compressor of claim 2 wherein a second bearing is disposed within said central opening of said front end plate to rotatably support said drive shaft.

5. The compressor of claim 3 wherein a second bearing is disposed within said central opening of said front end plate to rotatably support said drive shaft.

6. A compressor comprising:

a housing having a plurality of cylinders and a crank chamber;

a reciprocative piston slidably fitted within each of said cylinders;

a front end plate attached to one end surface of said housing, said front end plate having a central opening;

a drive mechanism coupled to said pistons to reciprocate said pistons within said cylinders, said drive mechanism including a drive shaft which extends through said central opening of said front end plate and is rotatably supported thereby, a cam rotor attached to one end of said drive shaft to rotate therewith and a drive plate coupled between said cam rotor and said pistons to translate the rotation of said cam rotor to reciprocation of said pistons; and support means formed within said cam rotor, radially fixed in close proximity to the drive shaft, and interfitted with said front end plate for rotatably supporting said drive mechanism on said front end plate.

7. The compressor of claim 6 wherein said support means includes a cylindrical depression formed in an end surface of said cam rotor facing an inner surface of said front end plate, an annular cylindrical projection extending from said inner surface of said front end plate to a position within said cylindrical depression, an annular space formed between an outer peripheral surface of said annular cylindrical projection and a side wall of said cylindrical depression and a bearing fixedly disposed in said annular space.

8. The compressor of claim 6 wherein said support means includes an annular cylindrical depression formed in an end surface of said cam rotor facing an inner surface of said front end plate, an annular cylindrical projection extending from said inner surface of said front end plate to a position within said annular cylindrical depression, an annular space formed between an inner side wall of said annular cylindrical depression and an inner peripheral surface of said annular cylindrical projection, and a bearing fixedly disposed in said annular space.

9. A compressor comprising:

a housing having a plurality of cylinders and a crank chamber;

a reciprocative piston slidably fitted within each of said cylinders;

a front end plate attached to one end surface of said housing, said front end plate having a central opening;

a drive mechanism coupled to said pistons to reciprocate said pistons within said cylinders, said drive mechanism including a drive shaft which extends through said central opening of said front end plate and is rotatably supported thereby, a cam rotor attached to one end of said drive shaft to rotate therewith and a drive plate coupled between said cam rotor and said pistons to translate the rotation of said cam rotor to reciprocation of said pistons;

a first support means formed within said cam rotor, radially fixed distally to the drive shaft, and coupled to said front end plate; and a second support means formed within said cam rotor, radially fixed proximally to the drive shaft, and interfitted with said front end plate.

* * * * *